US005542212A

United States Patent [19]

Erickson et al.

[11] Patent Number: 5,542,212

[45] Date of Patent: Aug. 6, 1996

[54] LOCKING TERMINAL FOR FULL TILT DOUBLE-HUNG WINDOWS

[75] Inventors: Steven E. Erickson; Stanley D. Peterson, both of Lincoln, Nebr.

[73] Assignee: Outlook Window Partnership L.P., Lincoln, Nebr.

[21] Appl. No.: 422,434

[22] Filed: Apr. 14, 1995

[51] Int. Cl.[6] ..... E05D 15/22

[52] U.S. Cl. ..... 49/181; 49/176

[58] Field of Search ..... 49/380, 181, 176, 49/161, 445, 447, 254

[56] References Cited

U.S. PATENT DOCUMENTS

| | | | |
|---|---|---|---|
| 1,562,011 | 11/1925 | Sylvan . | |
| 2,987,758 | 6/1961 | Osten, Sr. . | |
| 3,124,849 | 3/1964 | Osten, Sr. | 20/52.2 |
| 3,429,071 | 2/1969 | Phillips | 49/181 |
| 3,524,282 | 8/1970 | Kraft et al. | 49/181 |
| 3,797,168 | 3/1974 | Trout | 49/181 |
| 3,842,540 | 10/1974 | Anderson | 49/181 |
| 4,364,199 | 12/1982 | Johnson et al. | 49/181 |
| 4,718,194 | 1/1988 | FitzGibbon et al. | 49/181 |
| 4,854,077 | 8/1989 | Rogers et al. | 49/322 |
| 4,887,389 | 12/1989 | Haltof | 49/181 |
| 4,922,657 | 5/1990 | Foss | 49/181 |
| 5,027,557 | 7/1991 | May | 49/181 |
| 5,077,939 | 1/1992 | Erickson | 49/380 |
| 5,189,838 | 3/1993 | Westfall | 49/181 |

OTHER PUBLICATIONS

J W Window Components, Inc. Brochure entitled "Sash Balances and Full Tilt Vinyl Jambliner For Wood Windows Designed For 1⅜" or 1¾" Sash".

*Primary Examiner*—Jerry Redman

*Attorney, Agent, or Firm*—Zarley, McKee, Thomte Voorhees & Sease; Dennis L. Thomte

[57] ABSTRACT

An improved locking terminal is provided for a full tilt, double-hung or single-hung window. The conventional full tilt, double-hung or single-hung window comprises a window frame having a pair of vertical jambs, each of which have a jambliner mounted therein. Each of the jambliners are provided with a pair of horizontally spaced and vertically disposed channel members which are open toward the sash sides of the window. A mechanical balance is mounted in each of the four channels and has a locking terminal associated therewith which is adapted to grip the walls of the channel to maintain the locking terminal in place in its respective channel when the sash is tilted inwardly for removal from the window frame. Each locking terminal includes a channel-shaped slide member with a back projecting from a lower end thereof and an arm projecting upwardly from the back, generally parallel to the slide member. A locking member is pivotally mounted on the back of the locking terminal for movement between an engaged position engaging a side wall of a jambliner channel, and a sliding position. The cam pivots extending from the sashes include a locking lug which is received between the walls of the channel-shaped slide member when the sash is tilted to its vertical position thereby preventing separation of the cam pivot from its locking terminal during shipment or wind loading.

7 Claims, 3 Drawing Sheets

LOCKING TERMINAL FOR FULL TILT DOUBLE-HUNG WINDOWS

TECHNICAL FIELD

The present invention relates generally to double-hung and single-hung windows and more particularly to an improved locking terminal for use with full tilt, double-hung and single-hung windows which prevents rotation or "flipping" of the locking terminal within its channel of a jambliner.

BACKGROUND OF THE INVENTION

Conventional double-hung and single-hung windows are mounted in a window frame which is attached to the structural framing of the surrounding wall. The window frame generally comprises a pair of horizontally spaced-apart vertical jambs having a jambliner mounted therein which faces the window opening. Each of the jambliners includes a pair of horizontally spaced-apart and vertically disposed channels in which mechanical balances are positioned. Each sash of the conventional double-hung or single-hung window is provided with cam pivots extending laterally therefrom adjacent the lower ends thereof for connection to locking terminals associated with the mechanical balances. When the upper end of one of the sashes is tilted inwardly to facilitate the removal of the sash from the window frame, the cam pivots on the sash to permit the knife lock portion of the locking terminal to engage one wall of the associated channel so that the locking terminal will remain in place, under tension, in its respective channel during the time that the window is removed from the frame.

However, a problem arises during re-installation of a window in the jambliner if the cam pivots on the sash are positioned below the locking terminals. In trying to raise the positioned window, the cam pivots will strike the back of the locking terminals, causing them to turn or "flip" and become jammed in place. This, in turn, prevents the window from being opened, because the cam pivots cannot engage and slide the jammed locking terminal.

Another problem common with prior art full tilt, double-hung and single-hung windows arose during the shipment thereof from the factory to the point of sale or use. During shipment, the jambs could bow outwardly with respect to the sashes, causing one or more of the cam pivots to become dislodged from the jambliner channel, causing the lock terminal to quickly move towards its mechanical balance. The movement of the locking terminal towards its mechanical balance is a snap-like action which may cause damage to the locking terminal or the mechanical balance itself. Further, once the window was ready for installation, the sashes had to be removed and the locking terminals repositioned in their proper position to facilitate the engagement of the cam pivots on the sashes with the locking terminals.

Although the problem of dislodged cam pivots was overcome by applicant's modified cam pivot, as shown and described in U.S. Pat. No. 5,077,939, which is made a part hereof by reference thereto, the problem of "flipping" locking terminals was not solved.

It is therefore a principal object of the invention to provide an improved locking terminal for a full tilt, double-hung or single-hung window.

Yet another object of the invention is to provide a locking terminal for a full tilt, double-hung or single-hung window which includes means for preventing the rotation or flipping thereof when improperly contacted by a pivot cam during re-installation of a window sash.

Still another object of the invention is to provide an improved locking terminal for a full-tilt, double-hung or single-hung window which receives a locking lug of a modified pivot cam.

These and other objects will be apparent to those skilled in the art.

SUMMARY OF THE INVENTION

An improved locking terminal is provided for a full tilt, double-hung or single-hung window. The conventional full tilt, double-hung or single-hung window comprises a window frame having a pair of vertical jambs, each of which have a jambliner mounted therein. Each of the jambliners are provided with a pair of horizontally spaced and vertically disposed channel members which are open toward the sash sides of the window. A mechanical balance is mounted in each of the four channels and has a locking terminal associated therewith which is adapted to grip the walls of the channel to maintain the locking terminal in place in its respective channel when the sash is tilted inwardly for removal from the window frame. Each locking terminal includes a channel-shaped slide member with a back projecting from a lower end thereof and an arm projecting upwardly from the back, generally parallel to the slide member. A locking member is pivotally mounted on the back of the locking terminal for movement between an engaged position engaging a side wall of a jambliner channel, and a sliding position. The cam pivots extending from the sashes include a locking lug which is received between the walls of the channel-shaped slide member when the sash is tilted to its vertical position thereby preventing separation of the cam pivot from its locking terminal during shipment or wind loading.

DESCRIPTION OF THE PREFERRED EMBODIMENT

Figure 1:
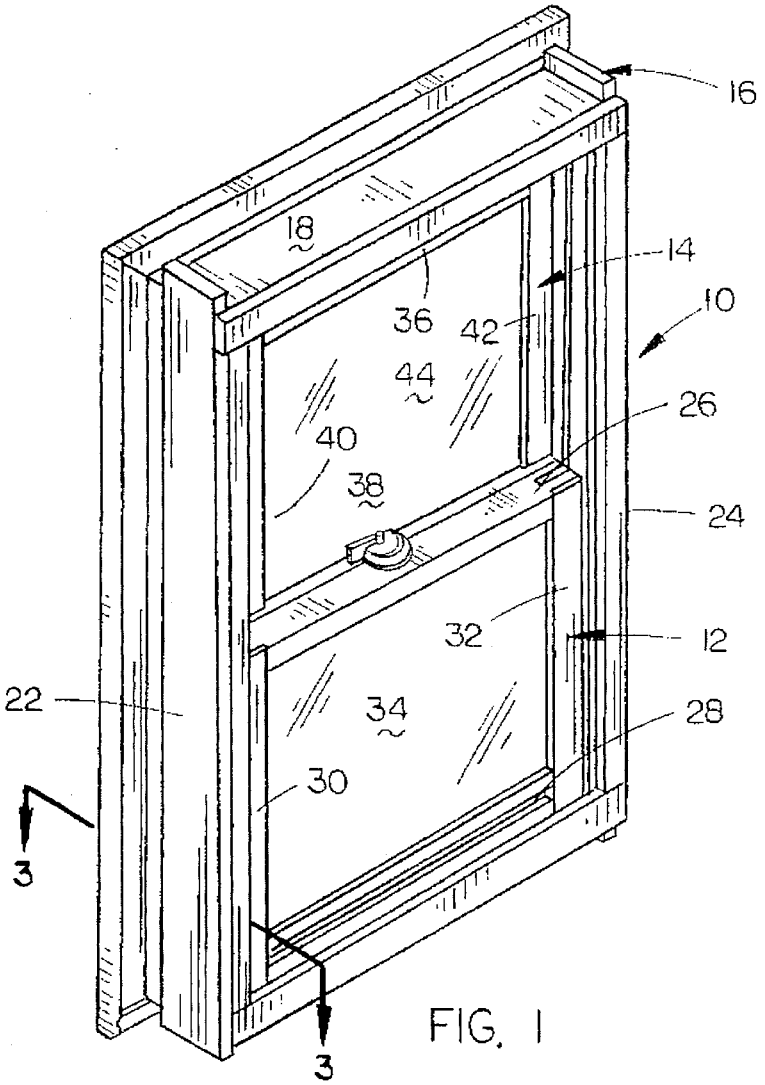
FIG. 1 is an interior perspective view of a full tilt, double-hung window installed in a frame.

Referring now to the drawings, in which identical or corresponding parts are identified with the same reference numerals throughout the drawings, and more particularly to FIG. 1, the numeral 10 generally designates a conventional full tilt, double-hung window including a movable lower sash 12 and a movable upper sash 14 mounted within a window frame 16. Window frame 16 may be attached to the structural framing of a surrounding wall in a conventional manner.

Window frame 16 includes a head 18, sill 20 (not shown in FIG. 1), and left and right jambs 22 and 24, respectively. Lower sash 12 is comprised of an upper rail 26, lower rail 28, and left and right stiles 30 and 32, with a pane of glass 34 mounted therein. Upper sash 14 is comprised of an upper rail 36, lower rail 38, and left and right stiles 40 and 42, with a pane of glass 44 mounted therebetween.

Figure 3:
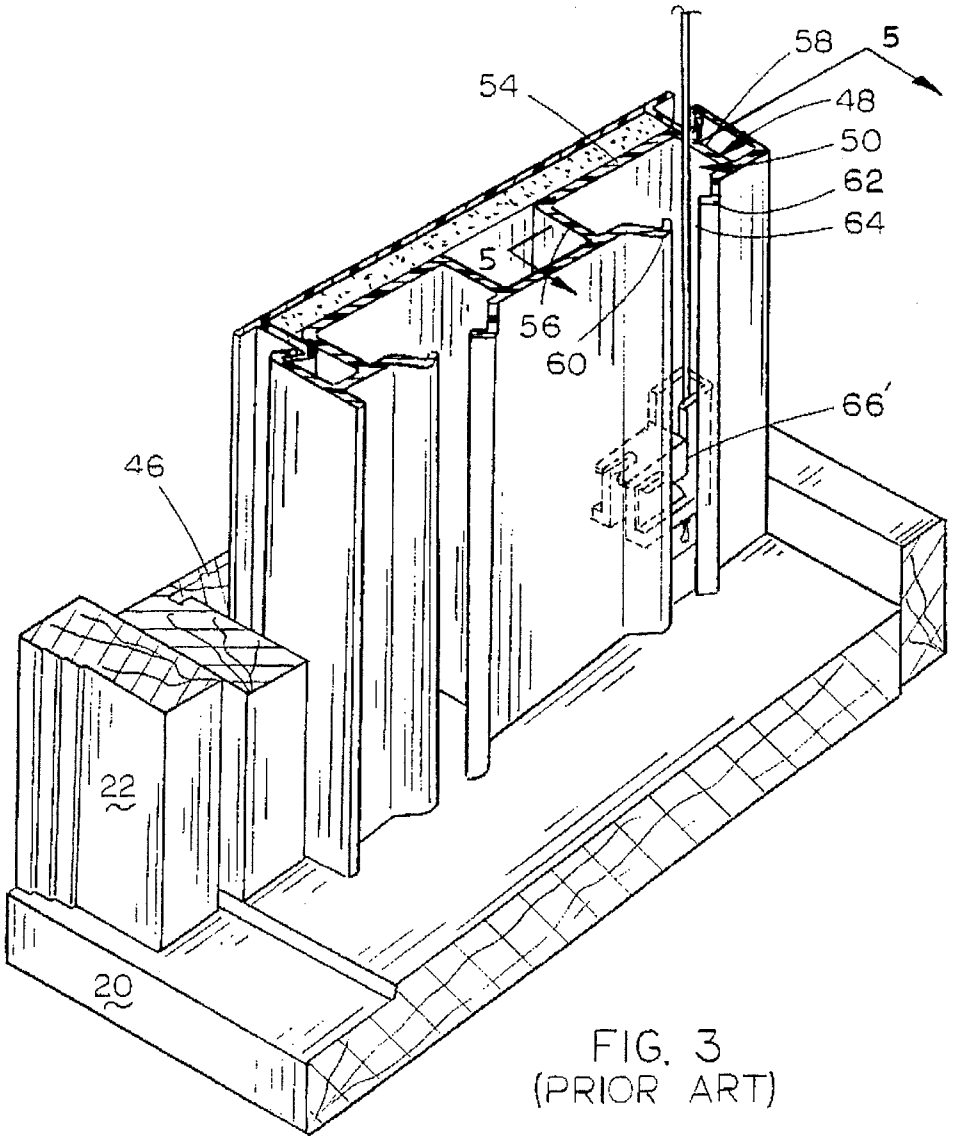
FIG. 3 (PRIOR ART)
FIG. 3 is a partial perspective view of the lower portion of the right side of a full tilt, double-hung window frame jamb illustrating the relationship of a prior art locking terminal with its jambliner channel.

Referring to FIG. 3, it can be seen that the conventional jamb 22 includes a pocket 46 into which is mounted a jambliner 48. Jambliner 48 is provided with a pair of horizontally spaced and vertically disposed channels 50 and 52. Inasmuch as each of the channels 50 and 52 are identical, only channel 50 will be described in detail.

As seen in the drawings, channel 50 includes a base wall 54, opposite side walls 56 and 58, and arcuate portions 60 and 62 defining an opening 64 therebetween. A conventional mechanical balance, such as that sold by J. W. Window Components, Inc. of 1009 Algonquin, Sioux Falls, S. Dak. 57104 under Model No. D-70, is installed in each of the channels 50 and 52 in conventional fashion. It should be noted that jamb 24 is also provided with a jambliner identical to jambliner 48 and which will have a pair of channels provided therein identical to channels 50 and 52. Similarly, mechanical balances of the type described will be mounted in each of the channels in the jambliner.

Figure 2:
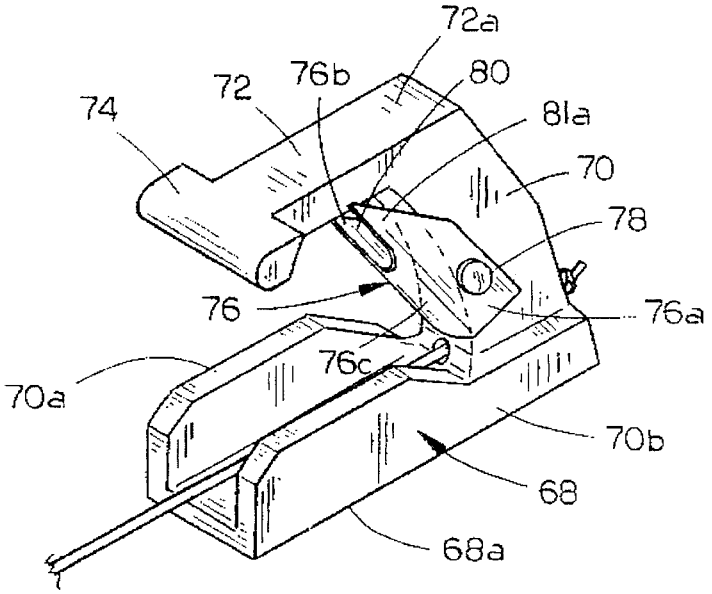
FIG. 2 is a perspective view of the locking terminal of the present invention.

Associated with each of the mechanical balances is the locking terminal of the present invention, referred to generally by the reference numeral 66. Referring to FIG. 2, locking terminal 66 includes a channel-shaped slide member 68 having a pair of upwardly projecting leg portions **70*a* and 70*b* which define a channel therebetween. A back 70 is affixed to the rearward end of slide member 68 and projects upwardly therefrom. An arm 72 projects forwardly from the upper end of back 70, with an upper surface 72*a* parallel to a bottom surface 68*a* of slide member 68. A head 74 is formed on the forward end of arm 72 and extends transversely a width greater than the width of arm 72, so as to form a general "T" shape with respect to arm 72**.

Figure 7:
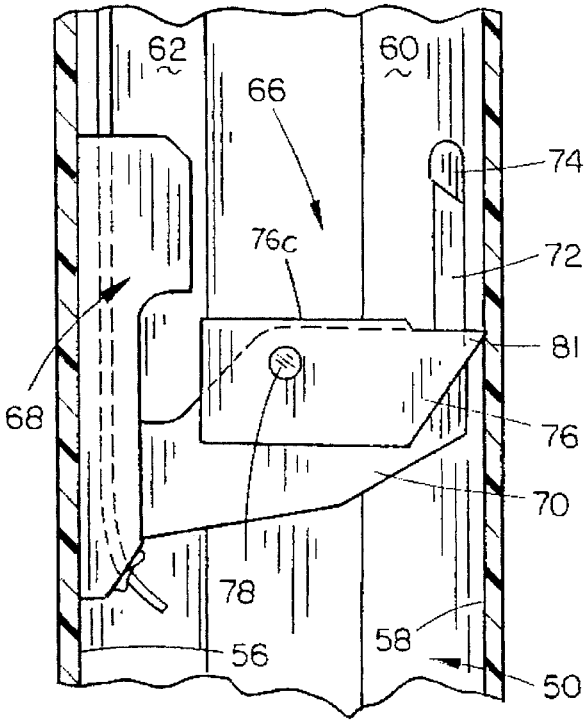
FIG. 7 is a view similar to FIG. 5, but showing the locking terminal of the present invention.

A channel-shaped knife section 76 is pivotally mounted to back 70 with a pin 78 oriented transversely through back 70 and through the opposing side walls **76*a* and 76*b* of knife section 76. Knife section 76 is pivotally mounted with its base portion 76*c* oriented forwardly of back 70 and side walls 76*a* and 76*b* projecting rearwardly on opposing sides of back 70. A notch 80 is formed in the upper end of knife section base 76*c*, and has a width slightly greater than the width of back 70. The upper end of side walls 76*a* and 76*b* are truncated so as to slope rearwardly from base 76*c* to the free edges of the side walls, thereby forming points or teeth 81*a* and 81*b* on opposing sides of notch 80. As shown in FIG. 7, teeth 81 will engage the inner side wall 58 of channel 50 when pivoted to a first position, to prevent upward movement of locking terminal 66 within channel 50. In the "engaged" position, notch 80 will receive back 70 and arm 72 therebetween such that teeth 81 project upwardly beyond the upper surface 72*a* of arm 72**.

Figure 5:
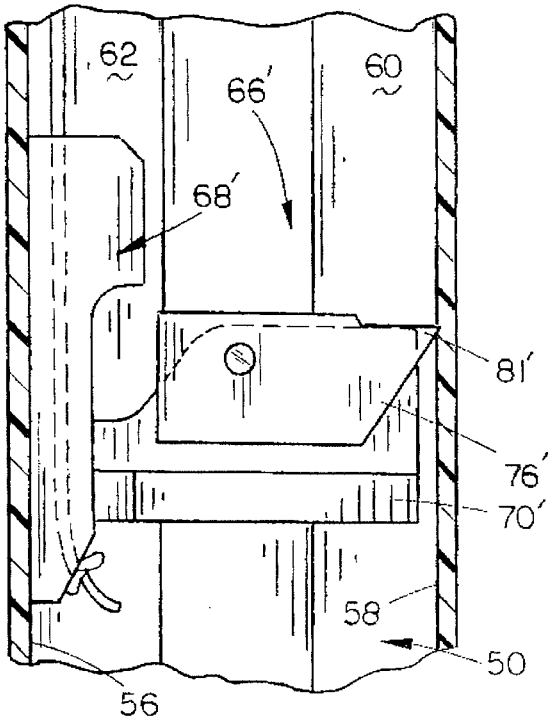
FIG. 5 PRIOR ART
FIG. 5 is a vertical sectional view of a prior art locking terminal as seen on lines 5—5 in FIG. 3 in its installed position.
Figure 6:
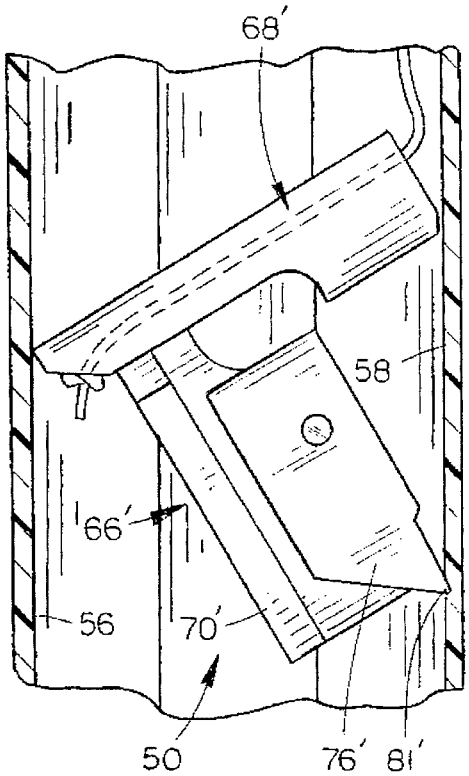
FIG. 6 PRIOR ART
FIG. 6 is a view similar to FIG. 5, but showing a prior art locking terminal "flipped" within the jambliner channel.

As shown in FIG. 7, arm 72 and head 74 serve to prevent rotational movement, or "flipping" of the locking terminal 66 within channel 50. FIG. 5 shows a prior art locking terminal 66' having a slide member 68', back 70' and knife section 76', with teeth 81' engaged in side wall 58 of channel 50. It can be seen that a dynamic force directed upwardly along channel 50 contacting back 70' would cause the prior art locking terminal 66' to pivot about teeth 81', causing slight expansion of channel 50, and jamming the locking terminal in a flipped orientation, as shown in FIG. 6. On the other hand, referring to FIG. 7, it can be seen that the same dynamic force applied to the back 70 of locking terminal 66 would cause pivotal movement of the locking terminal about teeth 81. However, arm 72 and head 74 would immediately contact side wall 58 preventing further "flipping" or pivotal movement.

Figure 4:
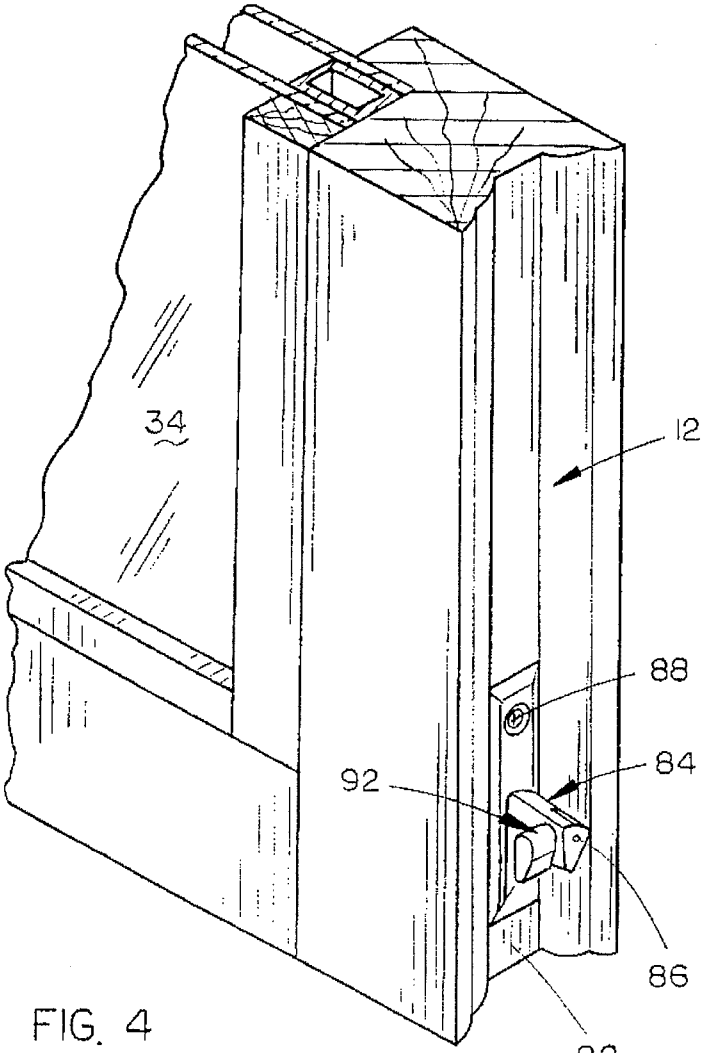
FIG. 4 is a perspective view of a cam pivot with a locking lug, mounted in the lower right plough of a window sash.
Figure 8:
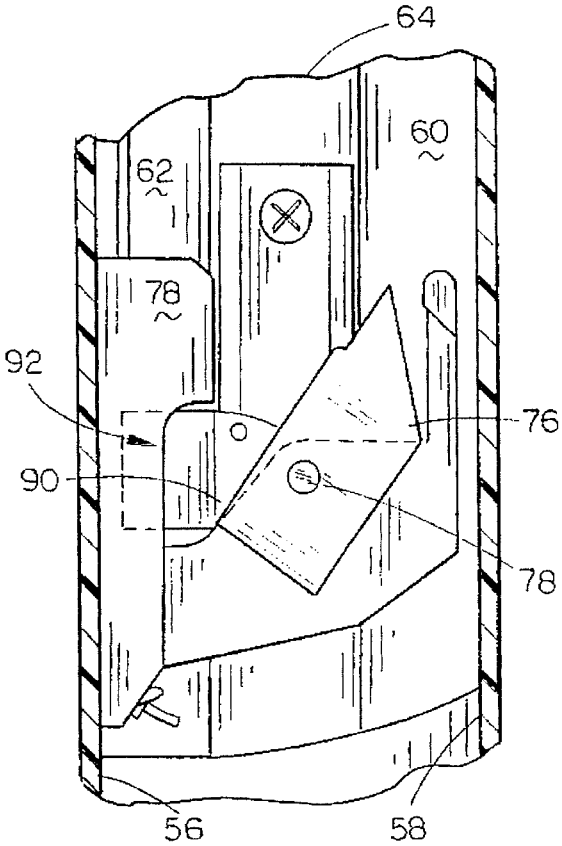
FIG. 8 is a view similar to FIG. 7, but with the cam pivot of a sash engaging the terminal to the "unlocked" position.

As seen in FIG. 4, each of the sashes are provided with ploughs 82 formed in the sides thereof which are adapted to slidably embrace the arcuate portions 60 and 62 of the jambliner channels. Cam pivots 84 are mounted in the ploughs at each side of each of the sashes adjacent the lower ends thereof by means of nail 86 and screw 88. Each of the cam pivots 84 includes a V-shaped cam portion 90 which is adapted to be received between end 92 of knife section 76 and slide member 68 to disengage teeth **81*a* and 81*b* of the knife section 76 from the inner surface of wall 58 of channel 50 during the installation of the sash into the window frame, as shown in FIG. 8**.

When the window has been assembled and is being shipped or being wind-loaded, the cam portion 90 of unmodified cams can move laterally with respect to locking terminal 66 and can thus become disengaged therefrom which will permit the locking terminal 66 to snap towards the associated mechanical balance. To prevent such separation of the cam pivot from the locking terminal 66, cam portion 90 is provided with a laterally extending locking lug 92 having a tapered portion 94 at one end thereof. As seen in FIG. 8, when the sash has been pivoted to its vertically disposed installed position in the window frame, locking lug 92 is positioned between the legs **68*a* and 68*b* of slide member 68 with the legs 68*a* and 68*b* preventing lateral movement of cam pivot 84 with respect to the locking terminal 66. The tapered portion 94 on the end of locking lug 92 facilitates the locking lug moving into place between the legs 68*a* and 68*b***.

Whereas the invention has been shown and described in connection with the preferred embodiment thereof, many modifications, substitutions and additions may be made which are within the intended broad scope of the appended claims.

I claim:

1. A locking terminal for receiving a cam pivot in full tilt, double-hung and single-hung windows, comprising:

an elongated slide member having a base portion and a pair of opposing, upwardly extending side walls, said slide member having forward and rearward ends and a channel extending from the forward end to the rearward end;

a back projecting upwardly from the rearward end of the slide member and having forward and rearward faces and opposing side walls;

an arm affixed to an upper end of the back and projecting forwardly therefrom generally parallel to base portion of the slide member, said arm having an upper surface extending generally parallel to the base portion of the slide member;

a locking member pivotally mounted on the back for movement between an engaged position and a sliding position;

said locking member having a tooth which projects upwardly beyond said arm upper surface when the locking member is in the engaged position, and projects below the arm upper surface when in the sliding position.

2. The locking terminal of claim 1, wherein said locking member is channel-shaped, with a base portion and opposing side walls, and further comprising a pivot pin extending between said locking member side walls and journaled through a transverse aperture in the back, for pivotal movement of the locking member thereon, said locking member positioned with its base portion located forwardly of the back forward face.

3. The locking terminal of claim 1, wherein said arm includes a head portion formed on a forward end thereof, the head portion projecting transversely beyond sides of the arm.

4. In combination:

a window frame having a pair of vertical jambs mounted to a surrounding wall;

each of said jambs including a vertically-extending jamb pocket for receiving a jambliner therein;

a first jambliner mounted in one of said jamb pockets, a second jambliner mounted in the other of said jamb pockets;

each of said first and second jambliners having inner and outer vertically disposed and horizontally spaced channels formed therein, each of said channels including a base wall and spaced-apart side walls;

an upper sash selectively vertically and removably mounted between said first and second jambliners adjacent said outer channels;

a lower sash selectively vertically and removably mounted between said first and second jambliners adjacent said inner channels;

a mechanical balance mounted in upper ends of each of said channels and including a cord extending downwardly therefrom in its respective channel;

a locking terminal mounted in each of said channels below an associated mechanical balance, each of said locking terminals being secured to the cord in the respective channel;

each of said locking terminals comprising:

a channel-shaped slide member including a base portion and opposing side portions, said base portion of said slide member being closely positioned to a first of said side walls of an associated jambliner channel, said side portions of said slide member extending towards a second of said side walls of the associated jambliner channel;

a back projecting from a lower end of the slide member and towards said second jambliner channel side wall;

an arm affixed to said back and projecting upwardly therefrom generally parallel to the base portion of the slide member said arm being closely position to said second jambliner channel side wall;

a locking member pivotally mounted on said back for selective engagement with said second side wall of the associated jambliner channel to lock said locking terminal in place within its channel when an upper end of an associated sash is tilted inwardly from between said jambliners;

each of said sashes having a cam pivot pin extending laterally from opposite sides thereof adjacent a lower end thereof;

said cam pivot pin adapted to engage said locking members to cause said locking member to move out of engagement with the second side wall as the upper end of the associated sash is tilted upwardly from a substantially horizontal position between said jambliners to a vertical position;

said cam pivot pin having a locking lug extending therefrom which is positioned between said side walls of said slide member channel to prevent said cam pivot pin from disengaging from said locking terminal when the associated sash is mounted between said jambliners.

5. The locking terminal of claim 4, wherein said locking member is channel-shaped, with a base portion and opposing side walls, and further comprising a pivot pin extending between said locking member side walls and journaled through a transverse aperture in the back, for pivotal movement of the locking member thereon, said locking member positioned with its base portion located forwardly of the back forward face.

6. The locking terminal of claim 4, wherein said arm includes a head portion formed on a forward end thereof, the head portion projecting transversely beyond sides of the arm.

7. In combination:

a window frame having a pair of vertical jambs mounted to a surrounding wall;

each of said jambs including a vertically-extending jamb pocket for receiving a jambliner therein;

a first jambliner mounted in one of said jamb pockets, a second jambliner mounted in the other of said jamb pockets;

each of said first and second jambliners having inner and outer vertically disposed and horizontally spaced channels formed therein, each of said channels including a base wall and spaced-apart side walls;

an upper sash selectively vertically and removably mounted between said first and second jambliners adjacent said outer channels;

a lower sash selectively vertically and removably mounted between said first and second jambliners adjacent said inner channels;

a mechanical balance mounted in upper ends of each of said channels and including a cord extending downwardly therefrom in its respective channel;

a locking terminal mounted in each of said channels below an associated mechanical balance, each of said locking terminals being secured to the cord in the respective channel;

a channel-shaped slide member including a base portion and opposing side portions, said base portion of said slide member being closely positioned to a first of said side walls of an associated jambliner channel, said side portions of said slide member extending towards a second of said side walls of the associated jambliner channel;

a back projecting from a lower end of the slide member and towards said second jambliner channel side wall;

an arm affixed to said back and projecting upwardly therefrom generally parallel to the base portion of the slide member, said arm being closely position to said second jambliner channel side wall;

a locking member pivotally mounted on said back for selective engagement with said second side wall of the associated jambliner channel to lock said locking terminal in place within its channel when an upper end of an associated sash is tilted inwardly from between said jambliners;

each of said sashes having a cam pivot pin extending laterally from the opposite sides thereof adjacent an lower end thereof;

said cam pivot pin adapted to engage said locking terminal to cause said locking member to move out of engagement with the second side wall as the upper end of the associated sash is tilted upwardly from a substantially horizontal position between said jambliners to a vertical position;

and means on said cam pivot for preventing said cam pivot from disengaging from its associated locking terminal when the associated sash is mounted between said jambliners.

* * * * *